US010399107B2

(12) United States Patent
Westfall

(10) Patent No.: US 10,399,107 B2
(45) Date of Patent: Sep. 3, 2019

(54) PAINT COLLAR

(71) Applicant: David Westfall, Binghamton, NY (US)

(72) Inventor: David Westfall, Binghamton, NY (US)

( * ) Notice: Subject to any disclaimer, the term of this patent is extended or adjusted under 35 U.S.C. 154(b) by 740 days.

(21) Appl. No.: 14/984,056

(22) Filed: Dec. 30, 2015

(65) Prior Publication Data

US 2016/0184856 A1 Jun. 30, 2016

Related U.S. Application Data

(60) Provisional application No. 62/097,890, filed on Dec. 30, 2014.

(51) Int. Cl.

| | |
|---|---|
| ***B05B 12/24*** | (2018.01) |
| ***B05B 12/20*** | (2018.01) |
| ***B05C 17/06*** | (2006.01) |

(52) U.S. Cl.

CPC ..... *B05B 12/24* (2018.02); *B05B 12/20* (2018.02); *B05C 17/06* (2013.01)

(58) Field of Classification Search

CPC ..... B05B 12/20–29; B05C 17/06

See application file for complete search history.

(56) References Cited

U.S. PATENT DOCUMENTS

| | | | | |
|---|---|---|---|---|
| 1,287,181 | A | 12/1918 | Barker | |
| 1,386,706 | A | 8/1921 | Hall | |
| 1,411,462 | A | 4/1922 | Wendt | |
| 3,422,798 | A | 1/1969 | Pine | |
| 4,241,693 | A | 12/1980 | Shotwell | |
| 4,258,654 | A | 3/1981 | Ivankovich | |
| 4,940,624 | A * | 7/1990 | Horiki | B29C 53/063 428/159 |

* cited by examiner

*Primary Examiner* — Yewebdar T Tadesse
*Assistant Examiner* — Stephen A Kitt
(74) *Attorney, Agent, or Firm* — Global Intellectual Property Agency, LLC; Daniel Boudwin

(57) ABSTRACT

A paint collar is provided that provides a spray shield for a surface around a work piece while painting, coating, or spraying the work piece. The paint collar has a first member and a second member that form around the work piece, thereby forming a contiguous paint shield surface. The first member and the second member abut against one another along aligned inner edges when the paint collar is in a working state. Along the inner edges of each member is a notch, which forms an aperture to allow the work piece to extend through the paint collar when the paint collar is placed around the base thereof. The first and second members are connected via one or more connectors, which allow hinged movement or complete separation. In one embodiment, the aperture formed by the notches is sized for work piece that comprises an upstanding, four-by-four post.

8 Claims, 4 Drawing Sheets

PAINT COLLAR

CROSS REFERENCE TO RELATED APPLICATION

This application claims the benefit of U.S. Provisional Application No. 62/097,890 filed on Dec. 30, 2014, entitled "Paint Collar." The above identified patent application is herein incorporated by reference in its entirety to provide continuity of disclosure.

BACKGROUND OF THE INVENTION

Field of the Invention

The present invention relates to paint shields and overspray covers for painting, spraying, and other coating processes. More particularly, the present invention relates to a deployable shield that surrounds a work piece and clamps therearound. The device forms a paint collar that shields underlying surfaces while the work piece is being painted, sprayed, or coated.

Various techniques exist for painting structures while avoiding overspray or paint application on nearby surfaces not meant to be painted. The most common method is taping around the boundary of the area to be painted, and using drop clothes or other shrouds to prevent unwanted paint transfer. However, for projects that require repetitive or rapid application of paint or coatings, use of tape and drop clothes can cause unwanted delay. Alternatively, without marking off the area appropriately, paint can often spray or drip onto areas not designated for painting. Therefore, there exists a need for a paint protection without the use of tape or other cumbersome methods.

The present invention comprises a paint collar that acts as a deployable paint shield around a work piece. The device is designed to secure around the work piece, or abut against a work piece surface, and prevent paint from dripping, spraying, or otherwise transferring onto an underlying surface below the collar. In an exemplary embodiment, the paint collar is particularly suited for use in conjunction with four-by-four post work pieces, whereby the upstanding post can be painted while the underlying surface is shrouded by the collar. In other embodiments, the paint collar secures around a work piece of different geometry for the same effect. Further still, the straight edges of the paint collar may further be used to prevent paint transfer from one surface to another.

SUMMARY OF THE INVENTION

The following summary is intended solely for the benefit of the reader and is not intended to be limiting in any way. The present invention provides a new paint collar device, wherein the same can be utilized for providing convenience for the user when painting a structure and shielding a surrounding area.

It is therefore an object of the present invention to provide a new and improved paint collar device that has all of the advantages of the prior art and none of the disadvantages.

It is another object of the present invention to provide a paint collar device that comprises a first member and a second member, each member having a substantially planar surface, one or more outer edges, and an inner edge. The inner edge of the first member aligns with the inner edge of the second member when the paint collar is in a working state.

Another object of the present invention is to provide a paint collar device in which the first and second members further comprise a notch disposed along the inner edge thereof. The notches align with one another when the first and second members are positioned such that the inner edges of each are abutted against one another. The notches form an aperture through the paint collar device when the paint collar is in a working state, whereby the aperture is adapted to accept a structure therethrough and shroud a surrounding area while painting the structure.

Yet another object of the present invention is to provide a paint collar device that further comprises a connector between the first member and the second member, whereby the connector retains the paint collar in the working state and operably allows separation of the first member and the second member.

Another object of the present invention is to provide a paint collar device in which the outer edges of the first member and the outer edges of the second member further comprise an upstanding lip.

Another object of the present invention is to provide a paint collar device in which the connector further comprises a hinge between first member and the second member, whereby the hinge facilitates rotational separation of the first member from the second member.

Another object of the present invention is to provide a paint collar device in which the connector further comprises a snap connector between first member and the second member, whereby the snap connector secures the first member to the second member when in a working state.

Another object of the present invention is to provide a paint collar device in which the aperture between the first and second member further comprises a specific shape for accommodating an upstanding post through the paint collar when the paint collar is in a working state around the upstanding post. The specific shape may include a square shape, rectangular shape, rounded shape, or multi-faceted shape.

Another object of the present invention is to provide a paint collar device in which the first member and the second member further comprise rectangular surfaces.

Another object of the present invention is to provide a paint collar device in which the aperture further comprises a rectangular shape for accommodating a four-by-four inch upstanding post through the paint collar when the paint collar is in a working state around the upstanding post.

Another object of the present invention is to provide a paint collar device in which the inner edge of the first member further comprises a tongue portion extending therefrom, the inner edge of the second member further comprises a groove portion, and the groove portion of the second member is adapted to receive the tongue portion of the first member when the inner edge of the first member and the inner edge of the second member are aligned and the paint collar is in a working state.

Another object of the present invention is to provide a paint collar device in which the first member and the second member comprise a flexible, plastic material.

Another object of the present invention is to provide a paint collar device in which the first and second member further comprise three outer edges and one inner edge, forming substantially rectangular members.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
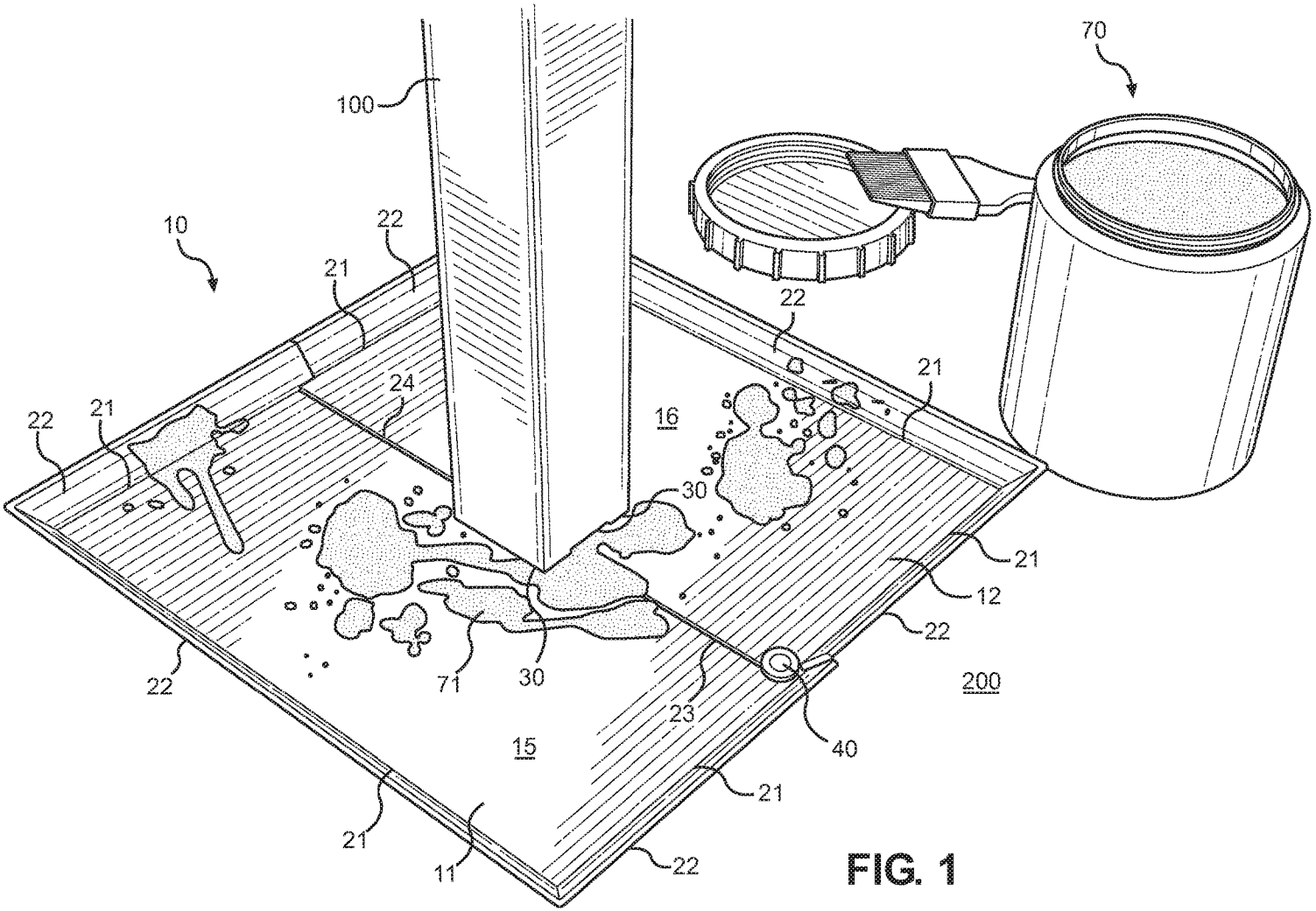
FIG. 1 shows a view of the paint collar of the present invention in a working state around an upstanding post being painted.

Reference is made herein to the attached drawings. Like reference numerals are used throughout the drawings to depict like or similar elements of the paint collar of the present invention. For the purposes of presenting a brief and clear description of the present invention, the preferred embodiment will be discussed as used for shielding an area to prevent paint dripping, overspray, bleeding, or other paint transfer onto a surrounding surface adjacent to a work piece. The figures are intended for representative purposes only and should not be considered to be limiting in any respect.

Figure 2:
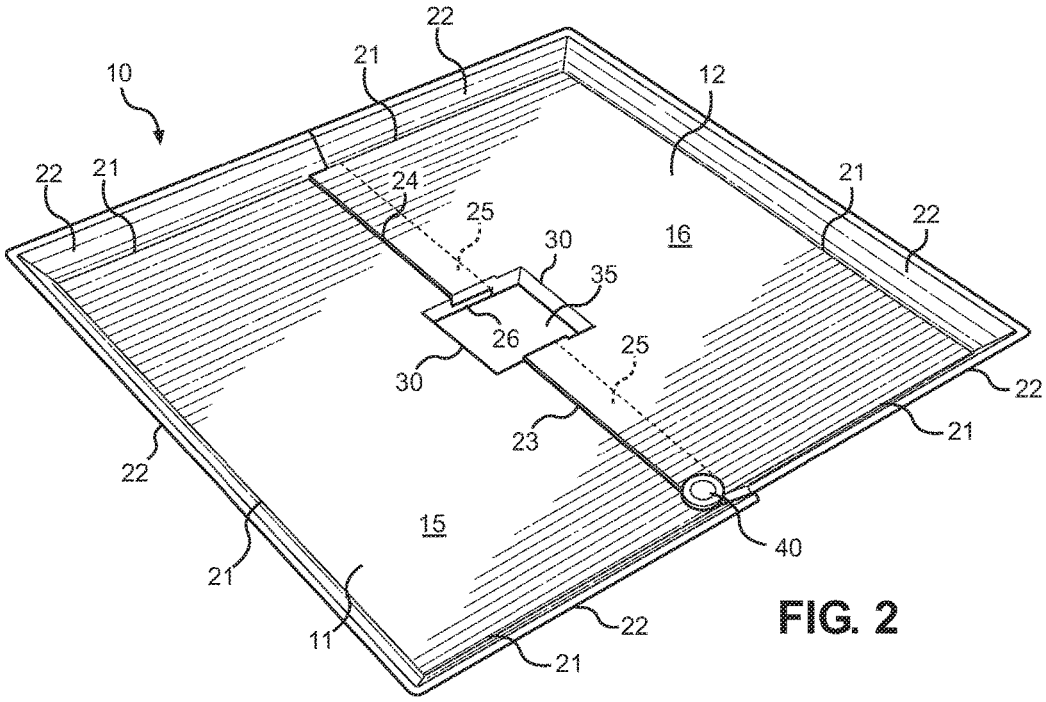
FIG. 2 shows an embodiment of the paint collar of the present invention in a working state.

Referring now to FIGS. 1 and 2, there are shown views of the paint collar device 10 of the present invention in a working state. The paint collar device 10 comprises a contiguous surface that is formed by a pair of paint shield members 11, 12. The members 11, 12 are used to prevent paint, stains, and other coatings 70 from spilling, splattering, or otherwise transferring onto surfaces nearby a work piece 100. The collar device 10 provides a shield upon which excess paint 71 or equivalent fluid can pool and be captured, thereby shielding nearby surfaces that are not to be coated. In use, the paint collar device 10 is secured around a work piece 100, or alternatively one of the edges of the device 10 are used to form a straight edge against a surface, thereby shielding a portion of the surface while painting or spraying the same.

The paint collar device 10 comprises a first member 11 and a second member 12. The first member 11 has a substantially planar surface 15, one or more outer edges 21, and an inner edge 24. The second member 12 similarly has a substantially planar surface 16, one or more outer edges 21, and an inner edge 23. The first 11 and second 12 members are operably affixed to one another by way of a connector or attachment device, whereby the members 11, 12 form a contiguous surface when joined. The first member 11 affixes to the second member 12 to form a working state when the inner edges 23, 24 of each are abutted against one another. The inner edges 23, 24 and the members 11, 12 themselves are secured together in a working state using one or more methods described herein.

Along the inner edges 23, 24 of each member is a notch. A first notch portion 30 is disposed along the inner edge 24 of the first member 11, and a second notch portion 30 is disposed along the inner edge 23 of the second member 12. The two notches 30 align with on another when the inner edges are abutted against one another to form an aperture 35 through the device 10. The aperture 35 is sized to receive a specific work piece therethrough, such as a four-by-four post or alternative structure that is to be painted. In this way, the paint collar device 10 can be secured around the periphery of a work piece 100 and secured together, thereby forming a shield surface therearound while painting the work piece.

While the user is coating the work piece 100 with paint 70 or the like, the paint collar device 10 can rest at the base of the work piece 100, or at a desired location therealong. Paint drippings 71 are collected on the surfaces 15, 16 of the device 10, and the underlying surface is not coated with paint 70 in the process. Along the outer edges 21 of the first member 11 and second member 12, an upstanding lip 22 may be provided to ensure paint drippings 71 do not leave the surface of the device. Similarly, to ensure the two members 11, 12 do not separate while in a working state (as shown in FIGS. 1 and 2), one or more connector devices are provided.

Figure 3:
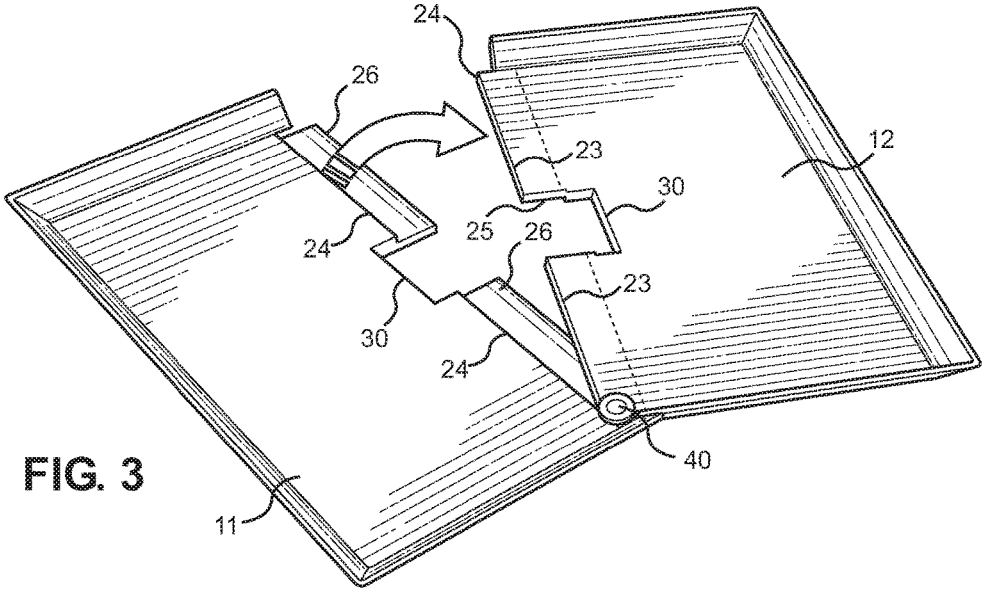
FIG. 3 shows an embodiment of the present invention in which the first member is being operably rotated away from the second member.

The first contemplated connector device is shown in FIGS. 1-3, and comprises a hinge 40 between first member 11 and the second member 12. The hinge 40 facilitates rotational separation of the first member 11 from the second member 12, and vice versa. The hinge 40 is preferably disposed along the jointed inner edges 23, 24 of the members 11, 12, and at a corner between one outer edge 21 and the inner edge 23, 24 of each member. In this way, the inner edges 23, 24 can rotate together to form a connected device in a working state (i.e. the inner edges 23, 24 abut against one another). Furthermore, the hinge 40 allows the edges 23, 24 to separate from one another and the members 11, 12 to pivot away from one another when opening the device into a non-working state (as shown in FIG. 3).

Figure 4:
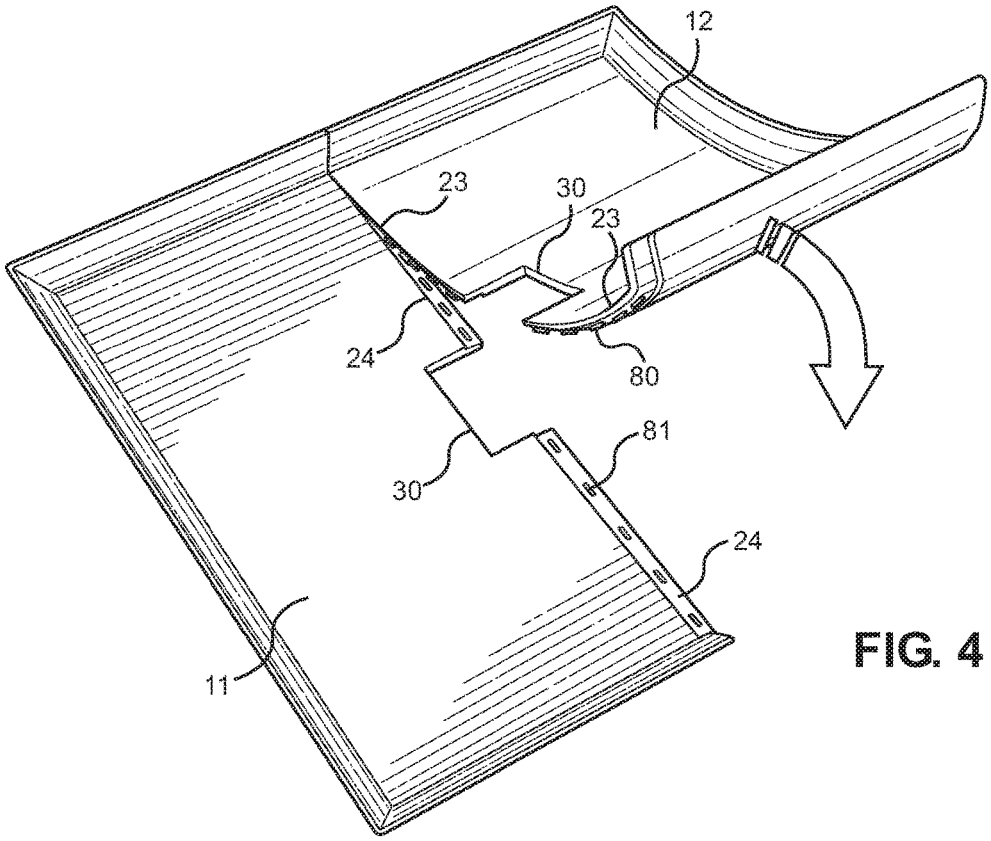
FIG. 4 shows another embodiment of the present invention, in which the first member is being disconnected from the second member.

Alternatively, the first member 11 and second member 12 are not pivotably connected by a hinge 40, but rather are snapped together as provided in FIG. 4. Using a snap connector along the inner edges 23, 24 of the members, the two members are removably connected together in a working state around the work piece 100. In particular, one or more tabs 80 are provided that engage corresponding depressions 81 across the interface between the two inner edges 23, 24 when the members 11, 12 are abutted against one another. The tabs 80 are pressed into the depressions 81 to snap the inner edges 23, 24 together about the work piece. This maintains the connection between the inner edges 23, 24 and ensures the collar device 10 remains in a working state while the work piece is being painted.

The paint collar device 10 of the present invention has two states: a working state, and a non-working state. The working state is shown in FIGS. 1-2, in which the inner edge 24 of the first member 11 is aligned against the inner edge 23 of the second member 12. In this state, the upper surface 15 of the first member, and the upper surface 16 of the second member 12 form a contiguous surface in which to support paint drippings and overspray around the work piece. The work piece is supported within the interior of the paint collar device 10, whereby the upper surface 15 of the first member 11 and the upper surface 16 of the second member 12 surround the work piece and capture drippings and overspray therearound. The underlying surface below the device 10 is shielded from paint.

The non-working state of the paint collar device is shown in FIGS. 3-4, in which the first member 11 is separated from the second member 12. This allows the device to be removed from the work piece and separated therefrom. The inner edge 24 of the first member 11 is separated from the inner edge 23 of the second member 12 as the members are pulled away from one another. In one embodiment, the hinge 40 allows the members to separate and the inner edges 23, 24 to pivot away from one another. In another embodiment, the members 11, 12 are flexible, and the inner edges 23, 24 can be peeled away from one another vertically, as shown in FIG. 4.

FIG. 4 also illustrates the second embodiment of the connectors. In this embodiment, the first member 11 is connected to the second member 12 along their inner edges 23, 24 using a snap connector arrangement. It is contemplated that the members be flexible in this embodiment, but it is not required. The snap connector embodiment comprises a plurality of tabs 80 disposed along the one inner edge, and a series of corresponding tab depressions 81 along an opposing inner edge. The tabs 80 align with the depressions 81 when the members 11, 12 are aligned and the inner edges 23, 24 overlap. The depressions 81 receive the tabs 80 and secure the two inner edges together, thereby securing the members 11, 12 together. The tabs 80 and depressions 80 may be disposed along overlapping shoulder portions that extend from the inner edges, whereby the shoulder portions comprise smaller cross sections to allow the shoulders to overlap one another along the intersection of the inner edges of the members when aligning the tabs 80 and depressions 81. This arrangement is commonly known as a lap joint arrangement.

Referring now to FIGS. 2 and 3, a view of the lap joint arrangement is shown in greater detail. In this embodiment, the inner edge 24 of the first member 11 further comprises a shoulder portion 26 extending therefrom, while the inner edge 23 of the second member 12 also comprises a corresponding shoulder portion 25. The shoulder portion 25 of the second member 12 is adapted to overlap the shoulder portion 26 of the first member 12 to form a lap joint at the intersection of the inner edges 23, 24. The inner edges 23, 24 abut one another and are aligned such that the shoulder portions overlap one another when the paint collar is in a working state. In this manner, the shoulder portions 25, 26 form half laps of the lap joint, which overlap one another.

Figure 5:
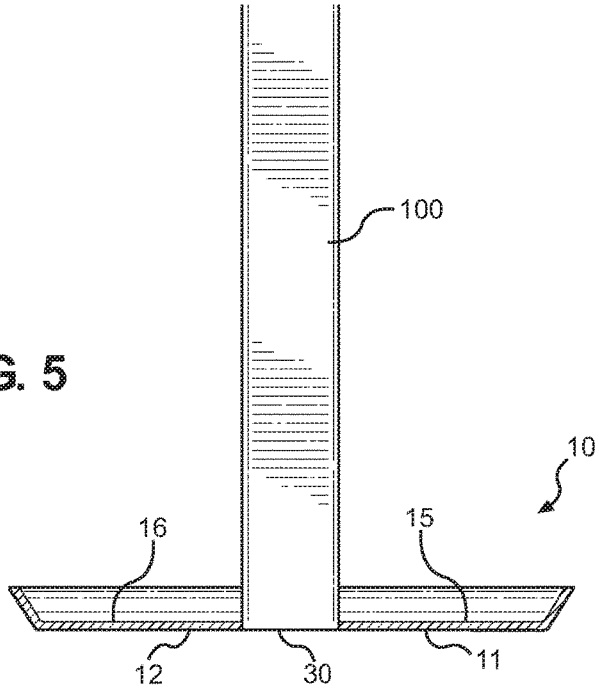
FIG. 5 shows a cross-section view of the paint collar in a working state around an upstanding post.

Referring to FIG. 5, the paint collar device 10 of the present invention is shown in a working state about a work piece 100. The upper surfaces 15, 16 of the device are disposed in alignment or near alignment, such that the upper surfaces 15, 16 form a substantially planar, contiguous surface for catching paint. The work piece 100 is received through the aperture formed by the notch portions 30, whereby the device 10 can be deployed around an existing, static work piece, or arrangement to function with a movable work piece. The connector secures the first member 11 to the second member 12 when in a working state. Different embodiments of the members 11, 12 are contemplated, including various shapes (e.g. rectangular, rounded, etc.), and furthermore the optimal material of the device 10 may be chosen for the given application (e.g. plastic, metallic, etc.). In addition, the aperture 35 formed by the notches in the device may comprise a square, rectangular, rounded, or multi-faceted shape when the device is connected and the members 11, 12 are aligned. The aperture 35 may be designed to function around a specific work piece requiring a specific shape. Overall, the device provides a useable paint shield that can be used for existing structures, and in an exemplary embodiment, about a four-by-four post.

Figure 6:
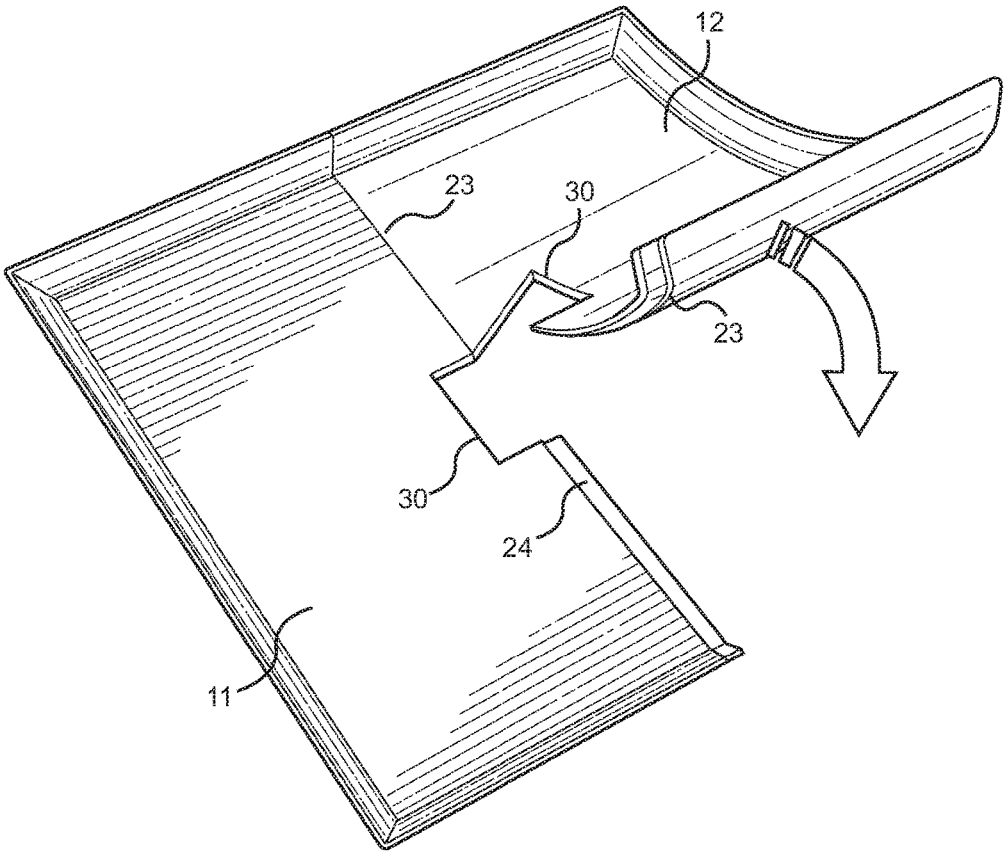
FIG. 6 shows an alternate embodiment of present invention.

Referring finally to FIG. 6, there is shown an alternate embodiment of the present invention. In this embodiment, the first member 11 and the second member 12 are connected along one side of the notch 30, and are separated along the inner edges 24, 23 along the opposite side of the notch 30. This embodiment contemplates no connectors between the members 11, 12, whereby the member comprise a flexible material to separate along the inner edges 23, 24 between the members 11, 12. The inner edges form a slit along on side of the device, which allows the device to open when surrounding an upstanding structure. The first member and the second member are formed of elastic material such that the first member may be separated from the second member along the separated inner edge.

Overall it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint collar, consisting of:

a first member having a substantially planar surface, one or more outer edges, and an inner edge;

a second member having a substantially planar surface, one or more outer edges, and an inner edge;

the inner edge of the first member aligning with the inner edge of the second member when the paint collar is in a working state;

a first notch disposed along the inner edge of the first member, a second notch disposed along the inner edge of the second member, the first notch and the second notch aligning when the paint collar is in the working state;

the first notch and the second notch forming an aperture through the paint collar when the paint collar is in a working state, whereby the aperture is adapted to accept a structure therethrough, wherein the paint collar is substantially perpendicular to the structure when the paint collar is in a working state;

a connector between the first member and the second member that retains the paint collar in the working state, and operably allows separation of the first member and the second member;

the paint collar further comprising a length, a width, and a height, wherein the length and the width are each greater than the height.

2. The paint collar of claim 1, wherein:

the outer edges of the first member and the outer edges of the second member further comprise an upstanding lip.

3. The paint collar of claim 1, wherein:

the connector further consists of a hinge between first member and the second member, whereby the hinge facilitates rotational separation of the first member from the second member.

4. The paint collar of claim 1, wherein:

the aperture further consists of a rectangular shape for accommodating an upstanding post through the paint collar when the paint collar is in a working state around the upstanding post.

5. The paint collar of claim 1, wherein the first member and the second member further comprise rectangular surfaces.

6. The paint collar of claim 1, wherein the aperture further consists of a rectangular shape for accommodating a four-by four inch upstanding post through the paint collar when the paint collar is in a working state around the upstanding post.

7. The paint collar of claim 1, wherein:

the inner edge of the first member further comprises a shoulder portion extending therefrom;

the inner edge of the second member further comprising a shoulder portion; and the shoulder portion of the second member is adapted to overlap the shoulder portion of the first member to form a lap joint when the inner edge of the first member and the inner edge of the second member are aligned and the paint collar is in a working state.

8. The paint collar of claim 1, wherein the first member and the second member further consists of a flexible, plastic material.

* * * * *